US011828576B2

(12) United States Patent
Glick

(10) Patent No.: US 11,828,576 B2
(45) Date of Patent: Nov. 28, 2023

(54) BULLET RESISTANT GARAGE DOORS

(71) Applicant: Amos B. Glick, Gap, PA (US)

(72) Inventor: Amos B. Glick, Gap, PA (US)

( * ) Notice: Subject to any disclaimer, the term of this patent is extended or adjusted under 35 U.S.C. 154(b) by 404 days.

(21) Appl. No.: 17/207,417

(22) Filed: Mar. 19, 2021

(65) Prior Publication Data

US 2021/0302130 A1 Sep. 30, 2021

Related U.S. Application Data

(60) Provisional application No. 62/994,040, filed on Mar. 24, 2020.

(51) Int. Cl.

| | |
|---|---|
| ***F41H 5/22*** | (2006.01) |
| ***E06B 3/70*** | (2006.01) |
| ***E06B 5/10*** | (2006.01) |
| ***F41H 5/04*** | (2006.01) |

(52) U.S. Cl.

CPC ..... *F41H 5/226* (2013.01); *E06B 3/7015* (2013.01); *E06B 5/10* (2013.01); *F41H 5/045* (2013.01); *E06B 2003/7023* (2013.01); *E06B 2003/7044* (2013.01); *E06B 2003/7051* (2013.01)

(58) Field of Classification Search

CPC ..... F41H 5/226; F41H 5/045; E06B 3/7015; E06B 5/10; E06B 2003/7023; E06B 2003/7044; E06B 2003/7051

USPC ..... 89/36.04

See application file for complete search history.

(56) References Cited

U.S. PATENT DOCUMENTS

| | | | | |
|---|---|---|---|---|
| 1,899,735 | A | 1/1932 | McClintock | |
| 5,429,340 | A | 7/1995 | Young | |
| 8,001,880 | B2 | 8/2011 | White | |
| 10,012,479 | B2 | 7/2018 | Boviall | |
| 10,281,245 | B2 | 5/2019 | DeKort | |
| 2015/0354926 | A1 | 12/2015 | Gibson | |
| 2018/0266172 | A1* | 9/2018 | Wray | E05F 17/004 |
| 2021/0088314 | A1* | 3/2021 | Azhagesan | F41H 5/226 |

* cited by examiner

*Primary Examiner* — Samir Abdosh

(74) *Attorney, Agent, or Firm* — Miller Law Group, PLLC

(57) ABSTRACT

A bullet-resistant garage door is formed with multiple garage door panels spaced vertically and pivotable relative to one another to permit conventional opening of the garage door. Each garage door panel is formed with an interior ballistic panel, an exterior ballistic panel and an insulation panel positioned between the interior and exterior ballistic panels. A ballistic shield is attached to the exterior ballistic panel to overlap the gap between the exterior ballistic panels of adjacent garage door panels. The exterior ballistic panel is operable to allow the penetration of a bullet of a given caliber while dissipating the energy of the bullet so that the bullet will not penetrate the interior ballistic panel and become trapped in the insulation panel. Sheeting and trim members can be attached to the exterior ballistic panel and the shield to provide an aesthetically pleasing appearance for the garage door panels while maintaining bullet-resistant characteristics.

17 Claims, 5 Drawing Sheets

Fig. 2
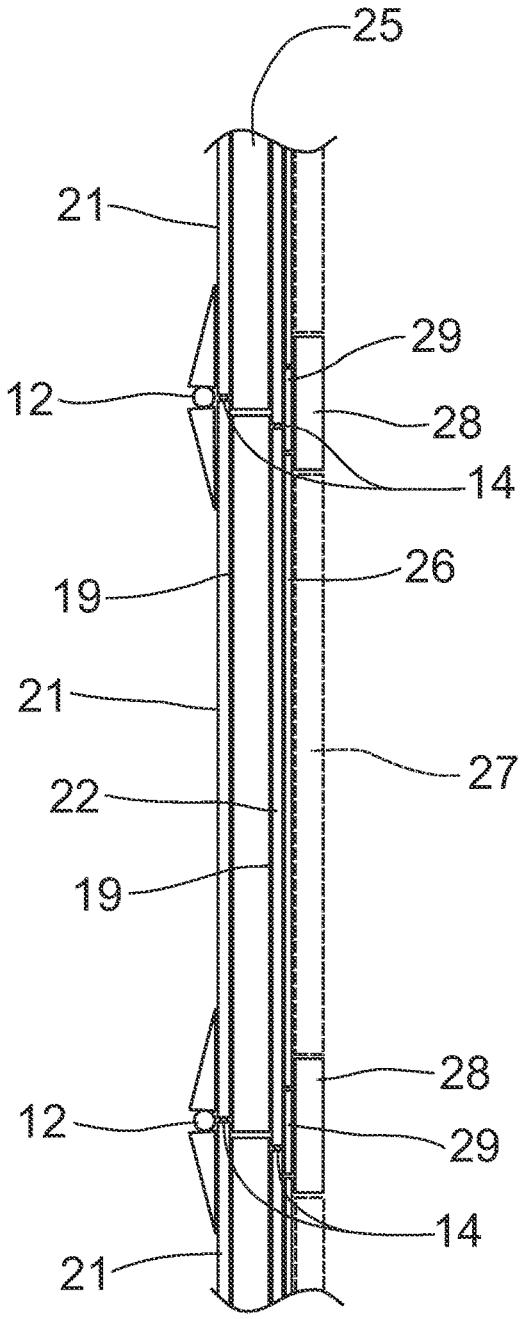
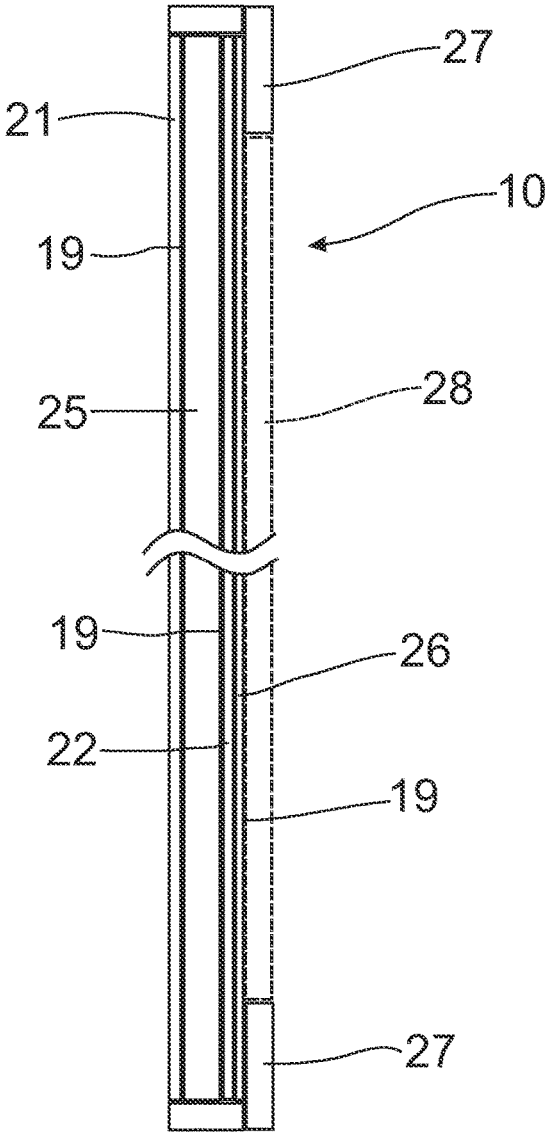
Fig. 3

Fig. 4
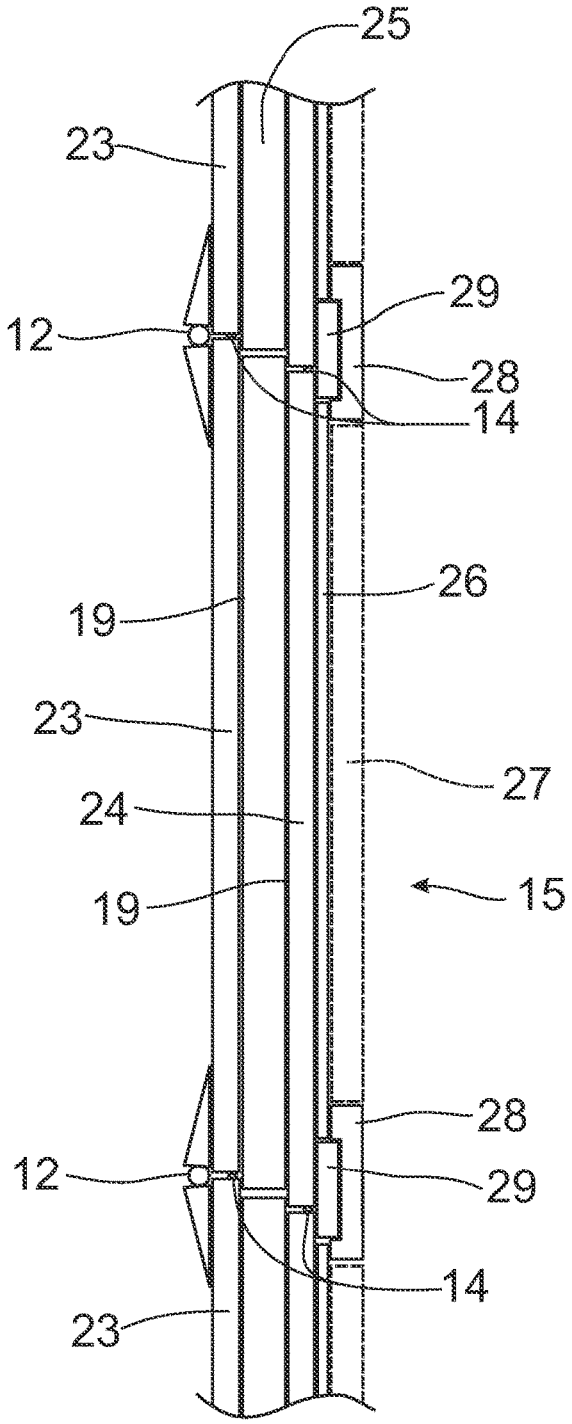
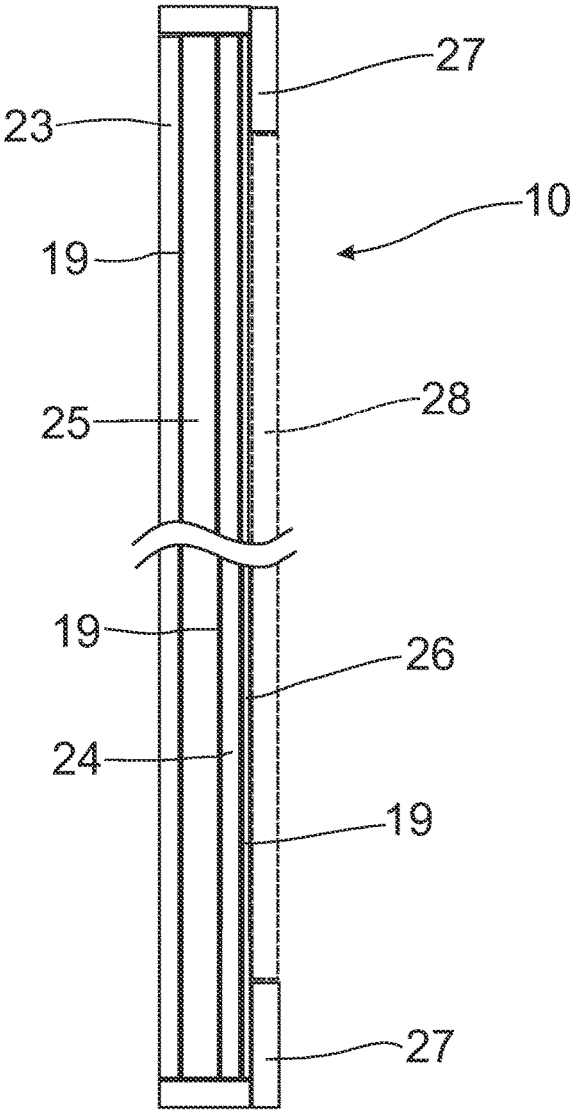
Fig. 5

BULLET RESISTANT GARAGE DOORS

CROSS-REFERENCE TO RELATED APPLICATIONS

This application claims domestic priority on U.S. Provisional Patent Application Ser. No. 62/994,040, filed on Mar. 24, 2020, the content of which is incorporated herein by reference.

FIELD OF THE INVENTION

This invention relates generally to a garage door providing security for property and occupants behind the garage door and, more particularly, to a security garage door that resists penetration through the garage door of bullets up to a predetermined caliber of bullet.

BACKGROUND OF THE INVENTION

Ballistic barriers have been designed and provided to resist and/or prevent the passage of bullets fired at the barrier. Such ballistic barriers have been used at indoor shooting ranges, as security fences for residences and commercial property and other establishments, and as shields for individuals advancing under fire. Ballistic barriers are typically formed of bullet resistant metal and are heavy and difficult to use because of that weight. As security fence structures and for other structures such as garage doors, the weight of the panels are difficult to install and to maintain.

In U.S. Pat. No. 1,899,735, granted on Jan. 22, 1932, to O. B. McClintock, a security barrier for bank tellers is disclosed in which the barrier is formed from a metal shell supporting bullet resistant glass and a complex structure to provide protection for a bank teller. A modular security fence is disclosed in U.S. Pat. No. 5,429,340, granted on Jul. 4, 1995, to Anthony M. Young, et al, in which the security fence is formed from overlapping panel modules. Each module is formed as an irregularly shaped open shell that interlocks with one or more adjoining modules or shells. Ballistic resistance is a result of opposing outer walls of the open shells when assembled together.

A ballistic barrier is disclosed in U.S. Pat. No. 8,001,880, granted to William C. White, et. al., on Aug. 23, 2011, wherein a lower barrier supports attack resistant panes extending upwardly from the barrier. The lower barrier provides protection from vehicle crashes, while the upper attack resistant panes are formed from material, such as plastic, acrylic and polycarbonates, among others, to resist penetration by bullets, particularly rounds fired by handguns. The ballistic wall structures disclosed in U.S. Patent Publication No. 2015/0354926, published on Dec. 10, 2015, by MGM Holdings, LLC, are designed for use in shooting ranges. The intent of this ballistic wall structure is to retain bullets within the wall structure. A ballistic curtain formed of ballistic rubber allows the passage of a bullet, while slowing the speed of the bullet so that the inner plate 54 stops the penetration of the bullet. The rubber curtain also prevents ricochets and fragments from passing back through the curtain.

Another ballistic barrier is disclosed in U.S. Pat. No. 10,012,479, granted to Michael Boviall on Jul. 3, 2018. This ballistic barrier is formed by a wall incorporating louvers or slats angled and overlapping to provide resistance to the passage of bullets by deflecting the path of the bullets downwardly to the ground. IN an alternative embodiment, the angled slats are backed by a backer plate that serves to further deflect the path of the bullets. A ballistic barrier designed to be portable in discrete panels and assembled in a selected location is disclosed in U.S. Pat. No. 10,281,245, granted on May 7, 2019, to Michael J. DeKort. Each panel can be connected to adjoining panels by hinges, and can, thereby, be folded for portability. Each panel is formed with a single pane of solid metal to provide bullet resistance.

Security doors have also been designed to resist bullet penetration, as can be seen in the security door configuration disclosed in U.S. Pat. No. 9,200,480, granted on Dec. 1, 2015 to Alan P. Deiler. In this Deiler patent, the security door is simply formed with an interior core of steel to resist bullet penetration. If a garage door were constructed according to this disclosed configuration, the garage door would have a tendency to ricochet bullets from the door, rather than to absorb the energy carried by the bullet striking the garage door. The ricocheting bullet can provide a dangerous situation to other people and property near the garage door being struck by the bullet. As one skilled in the art would readily recognize, allowing a bullet to ricochet is not a desirable performance.

Accordingly, it would be desirable to provide a bullet resistant garage door structure that can absorb energy from a bullet striking the garage door without allowing the bullet to penetrate the structure of the garage door, at least be effective to resist the passage of bullets therethrough up to a predetermined caliber of weapon.

SUMMARY OF THE INVENTION

It is an object of this invention to overcome the disadvantages of the prior art by providing a bullet-resistant garage door.

It is a feature of this invention to a garage door constructed with an interior aluminum panel, a spaced exterior aluminum panel, and an insulation panel located between the interior and exterior aluminum panels.

It is another object of this invention to create a garage door configuration that will allow bullets to pass through the exterior aluminum panel and then be trapped between the interior and exterior aluminum panels.

It is an advantage of this invention that the exterior aluminum panel is designed to allow penetration of a bullet while dissipating most of the kinetic energy of the bullet so that the bullet cannot penetrate the interior aluminum panel.

It is another advantage of this invention that the bullet resistant garage door will trap a bullet between the interior and exterior aluminum panels within the insulation panel.

It is still another object of this invention to provide a garage door configuration that will provide bullet resistant characteristics at the joints between vertically spaced garage door panels.

It is another feature of this invention that the interior aluminum panel of one garage door panel terminates at a small gap with respect to the interior aluminum panel of an adjacent garage door panel, and that the exterior aluminum panel of one garage door panel terminates at a small gap with respect to the exterior aluminum panel of an adjacent garage door panel, to permit one garage door panel to pivot relative to the adjacent garage door panel when the garage door is being raised to open.

It is still another advantage of this invention that the small gaps between the respective interior and exterior aluminum panels at any joint between adjacent garage door panels are spaced vertically to prevent horizontal alignment and a weakness in the bullet resistant characteristics of the garage door configuration.

It is still another feature of this invention that the gap between adjacent exterior aluminum panels is covered by a shield that enhances the bullet resistant characteristics of the garage door configuration.

It is yet another feature of this invention that the shield extends below the corresponding exterior aluminum panel to provide bullet resistant characteristics for the garage door as the garage door is being raised to open and adjacent garage door panels pivot relative to one another.

It is another advantage of this invention that the shield has a vertical height sufficient to cover both the gap between the adjacent interior aluminum panels and the gap between the adjacent exterior aluminum panels when the garage door is in the vertical closed position.

It is still another feature of this invention that the exterior aluminum panels can be covered with a sheet of material and associated trim members to provide an aesthetically pleasing outward appearance for the garage door providing bullet resistant characteristics.

It is yet another advantage of this invention that the aesthetically pleasing exterior architectural sheeting and millwork trim members for each garage door panel can be manufactured millwork products, such as is marketed under the trademark, Azek®.

It is another feature of this invention that the interior insulation panel located between the interior and exterior aluminum panels can be attached to these aluminum panels with a very high bonding adhesive tape.

It is still another advantage of this invention that the garage door panels can be constructed to provide an increased level of bullet resistant characteristics by forming the interior and exterior aluminum panels and the shield from thicker stock.

It is yet another feature of this invention that when the shield becomes thicker than the aesthetic sheeting on the outer face of the garage door panel, the corresponding trim member on the exterior face of the shield can be formed with a relief that will receive the excess thickness of the shield to maintain a pleasing aesthetic outer appearance for each respective garage door panel.

It is a further object of this invention to provide a bullet resistant garage door configuration which is durable in construction, carefree of maintenance, easy to assemble, and simple and effective in use.

These and other objects, features and advantages are accomplished according to the instant invention by providing a bullet resistant garage door formed with multiple garage door panels space vertically and pivotable relative to one another to permit conventional opening of the garage door. Each panel is formed with an interior aluminum panel, an exterior aluminum panel and an insulation panel positioned between the interior and exterior aluminum panels. An aluminum shield is attached to the exterior aluminum panel to overlap the gap between the exterior aluminum panels of adjacent garage door panels. The exterior aluminum panel is operable to allow the penetration of a bullet of a given caliber while dissipating the energy of the bullet so that the bullet will not penetrate the interior aluminum panel and be trapped in the insulation panel. Sheeting and trim members can be attached to the exterior aluminum panel and the shield to provide an aesthetically pleasing appearance for the garage door panels while maintaining bullet resistant characteristics.

BRIEF DESCRIPTION OF THE DRAWINGS

The advantages of this invention will become apparent upon consideration of the following detailed disclosure of the invention, especially when taken in conjunction with the accompanying drawings wherein:

FIG. 2 is a cross-sectional view of the garage door taken along lines 2-2 of FIG. 1 and forming a Class 1 bullet resistant configuration;

FIG. 3 is a cross-sectional view of the garage door taken along lines 3-3 of FIG. 1 and forming a Class 1 bullet resistant configuration;

FIG. 4 is a cross-sectional view of the garage door taken along lines 2-2 of FIG. 1 and forming a Class 2 bullet resistant configuration;

FIG. 5 is a cross-sectional view of the garage door taken along lines 3-3 of FIG. 1 and forming a Class 1 bullet resistant configuration;

DETAILED DESCRIPTION OF THE PREFERRED EMBODIMENT

Figure 1:
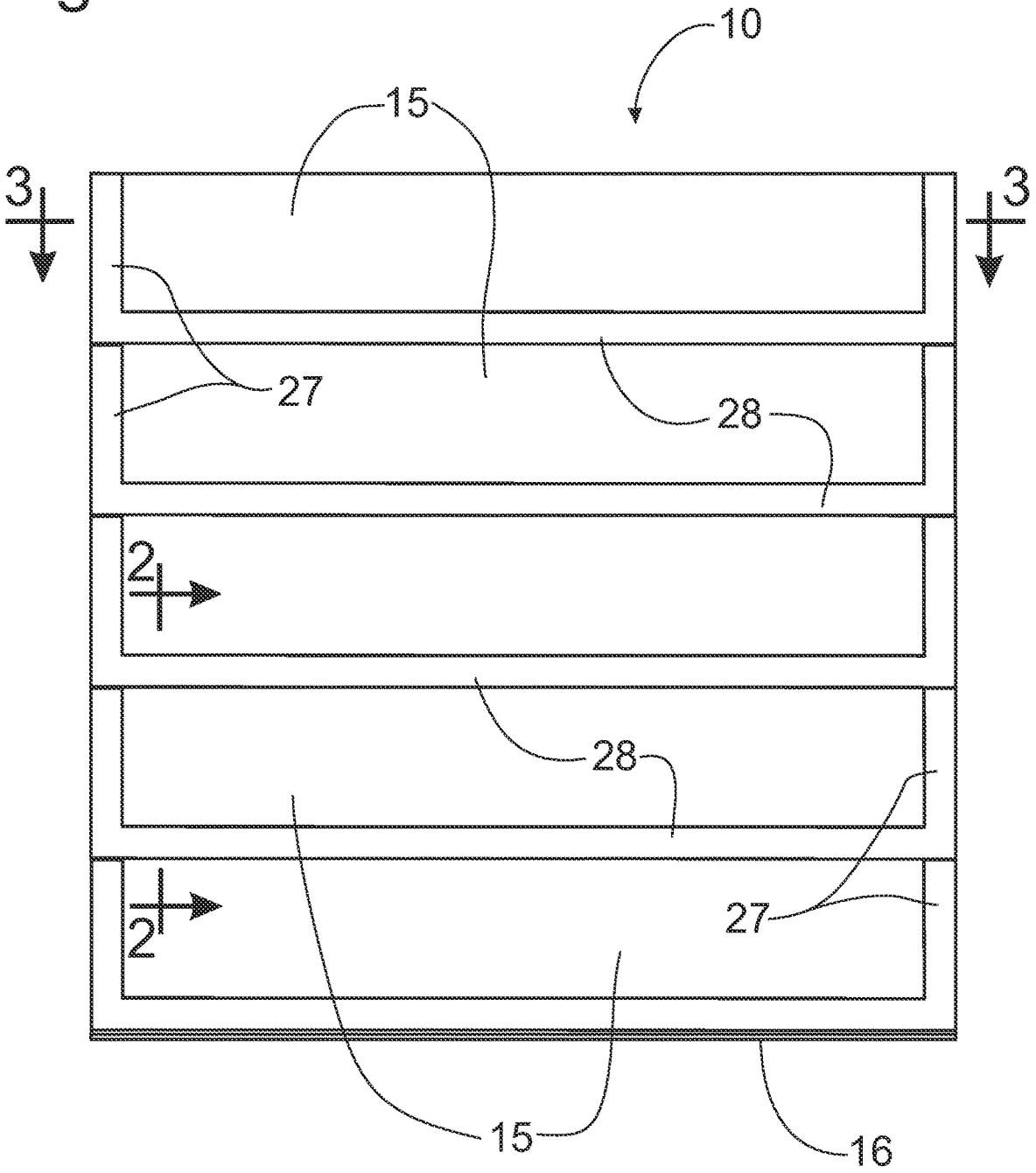
FIG. 1 is a schematic front elevational view of a bullet resistant security garage door in a closed orientation and incorporating the principles of the instant invention.
Figure 6:
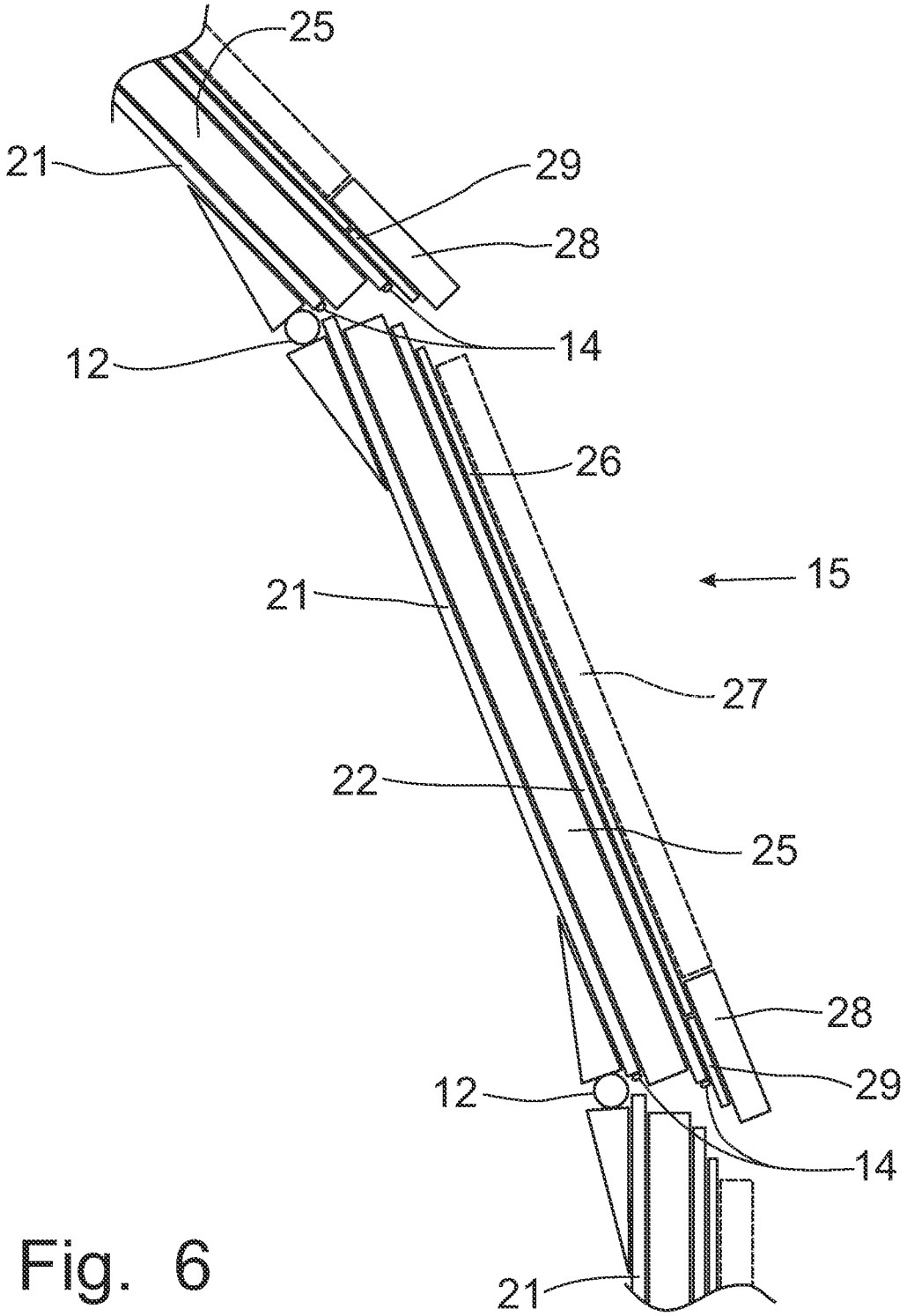
FIG. 6 is a cross-sectional view of the Class 1 bullet resistant garage door shown in FIG. 2 showing the orientation of the garage door being raised, or lowered, relative to the garage door opening.
Figure 7:
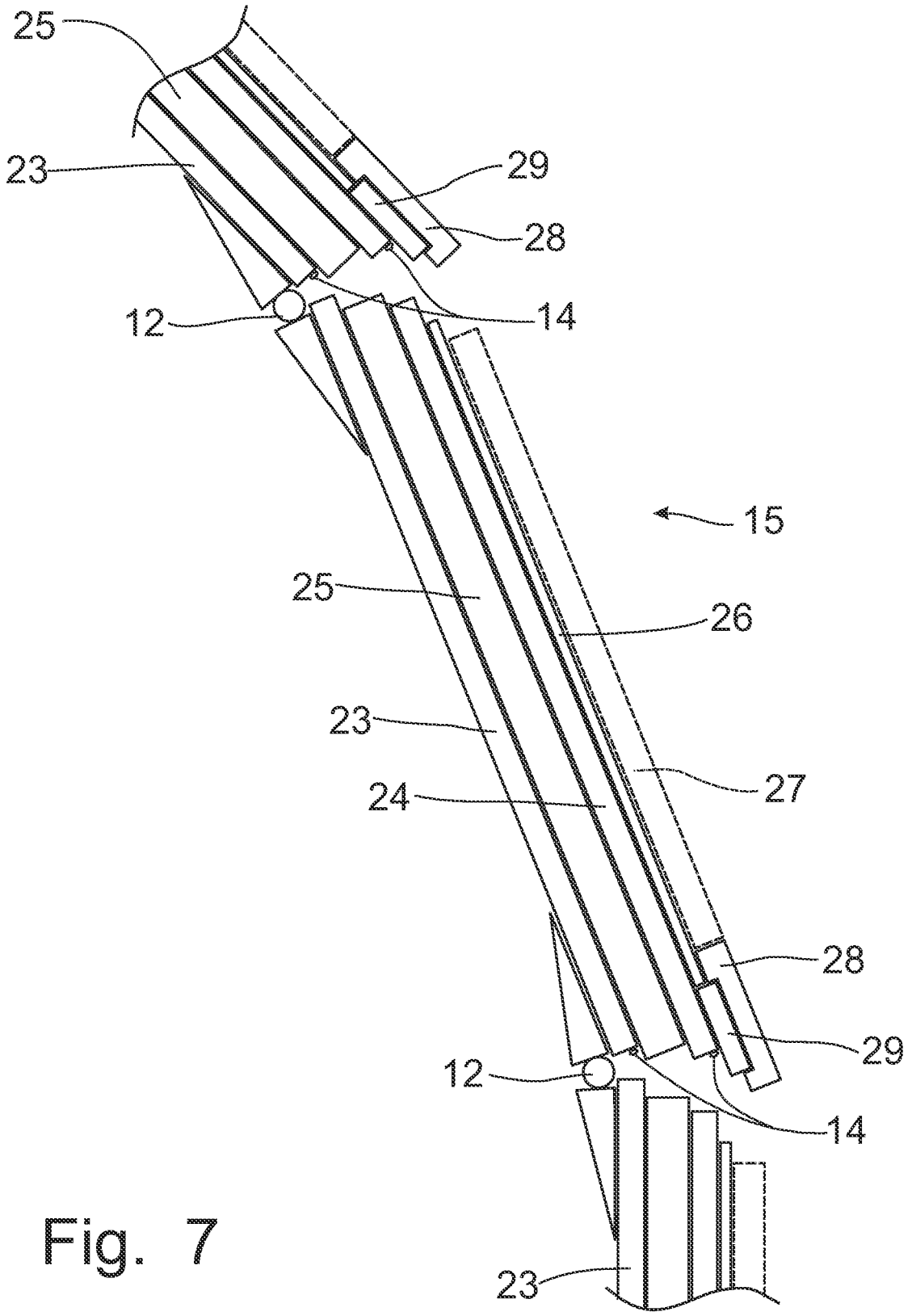
FIG. 7 is a cross-sectional view of the Class 2 bullet resistant garage door shown in FIG. 4 showing the orientation of the garage door being raised, or lowered, relative to the garage door opening.

Referring to the drawings, two embodiments of a bullet resistant garage door incorporating the instant invention can be seen, including a Class 1 bullet resistant configuration and a Class 2 bullet resistant configuration. The Class 2 configuration is effective to stop a higher caliber bullet than the Class 1 configuration. In general, the garage door 10 is formed from a plurality of horizontally extending panels 15 that are hinged together by hinges 12, in the same manner as a conventional garage door, to allow the respective panels 15 to pivot relative to one another, as is depicted in FIGS. 6 and 7, to permit raising and lowering of the garage door 10. Also, as is shown in FIG. 1, the garage door 10 will be formed with a conventional elastomeric seal 16 along the bottom edge to seal the garage door 10 against the lower surface of the garage structure (not shown) as is known in the art. Further, an elastomeric seal 14 is affixed to the interior and exterior panels to seal the joint between adjacent garage door panels 15.

Each garage door panel 15 is configured similarly to provide resistance to the penetration and deflection of bullets striking the exterior of the garage door 10. The Class 1 and Class 2 garage door panels 15 are formed with a pair of spaced apart ballistic panels that are separated by an interior core of insulation sheathing 25. Trim members, as will be described in greater detail below, are secured to the exterior ballistic panel to provide an aesthetically pleasing appearance for the garage door 10. Preferably, the interior core of an insulation foam panel 25, preferably poly iso sheathing 25, is secured to both of the interior and exterior ballistic panels by an adhesive, such as a very high bonding (VHB) adhesive tape 19. In addition, the trim members, as well as other components described in greater detail below, are preferably secured by adhesives or adhesive tape so that there is minimal thermal transfer through the garage door 10 having opposing ballistic panels 21, 22 or 23, 24 on the interior and exterior of the garage door 10.

Referring now to the Class 1 garage door configuration shown in FIGS. 2 and 3, one of ordinary skill in the art will note that both of the ballistic interior and exterior panels are preferably formed from metallic materials, and, more specifically, from 6063 aluminum and are preferably 5/16 inch thick with the poly iso sheathing between the interior and exterior aluminum panels 21, 22 is approximately one inch thick to provide appropriate insulation for the structure of the garage door 10. Secured to the front of the exterior aluminum panel 22 is a sheet of trim material 26, such as one-quarter inch thick manufactured architectural sheeting, for aesthetic appearances. Along the sides of each garage door panel 15, a vertical board of trim material, such as a three-quarter inch thick and three and one-half inch wide manufactured millwork trim member 27 which mates with a similar horizontal trim member 28, placed along the joint between the adjacent garage door panels 15 to provide an aesthetically pleasing appearance for the garage door 10.

One skilled in the art will recognize that the use of 6063 aluminum provides a lightweight metallic material that in appropriate thicknesses will establish the desired bullet resistance characteristics. However, other ballistic materials can be used to provide desired bullet resistance characteristics, including other metallic materials like hardened steel, ballistic steel, abrasion resistant steel, and others, and non-metallic ballistic materials such as ballistic fiberglass and carbon fiber and other composite materials. The use of 6063 aluminum as the preferred metallic material for the formation of the garage doors provides a lightweight and economical material for use in this application.

At the joint between adjacent garage door panels 15, the interior and exterior aluminum panels 21, 22 are terminated in a vertically spaced relationship to enhance the bullet resistant characteristics of the garage door 10. As depicted in FIG. 2, the interior aluminum panel 21 terminates at a location higher than the corresponding exterior aluminum panel 22 so that the gap between the interior panels 21 of adjacent garage door panels 15 is not aligned with the gap between the exterior panels 22 of adjacent garage door panels 15, when the garage door 10 is in a closed position as depicted in FIG. 2. One skilled in the art will recognize that the gap between exterior aluminum panels 22 of adjacent garage door panels 15 could be lower than the gap between corresponding interior aluminum panels 21 as long as the two respective gaps are not aligned when the garage door 10 is closed.

To reinforce the joint between adjacent garage door panels 15 and maintain a bullet resistance capability where the joint between adjacent garage door panels 15 is located, the exterior surface of each the garage door panel 15 is formed with a shield 29 preferably formed of a one-quarter inch thick, and two inches wide, 6063 aluminum for Class 1 ballistic security, positioned to cover the gap between both of the interior and exterior aluminum panels 21, 22 at each joint between vertically spaced garage door panels 15. Preferably, the manufactured architectural sheeting 26 on the respective adjacent garage door panels 15 are spaced apart sufficiently at the joint between the garage door panels 15 to allow the shield 29 to fit snuggly therebetween so that the horizontal manufactured millwork trim member 28 will cover the shield 29 for aesthetic purposes.

Referring now to FIG. 6, the relationship of the respective garage door panels 15 can best be seen. The horizontal hinges 12 between respective adjacent garage door panels 15 allow the garage door 10 to be raised from a vertical closed position to an elevated horizontal opened position by an electric motor (not shown), as is commonly known for the operation of garage doors. The respective garage door panels 15 are depicted in FIG. 6 as being rotated through the horizontal hinges 12 through a deflection angle of 22 degrees. One skilled in the art can see that the exterior aluminum panels 22 of adjacent garage door panels 15 are separated by a greater distance than the corresponding interior aluminum panels 22. The shield 29 on the exterior side of the exterior aluminum panels 22 extends below the terminus of the exterior aluminum panel 22 to which the shield 29 is attached. This specific garage door 10 configuration can still provide significant bullet resistant capability even as the garage door 10 is being raised into the open position.

The Class 2 bullet resistant garage door 10 is best seen in FIGS. 4, 5 and 7. The general configuration of the respective component parts of the Class 2 garage door 10 is essentially the same as the general configuration of the Class 1 garage door described above, except that the interior and exterior metallic panels 23, 24 are preferably formed with 6063 aluminum material of a greater thickness, preferably five-eighths inch thickness. As described above, the interior aluminum panel 23, the poly iso insulation panel 25, the exterior aluminum panel 24, exterior sheeting 26, shield 29, and trim members 27, 28 are preferably secured together with very high bonding (VHB) adhesive tape. The gaps between the interior aluminum panels 23 and the gaps between the exterior aluminum panels 24 of adjacent garage door panels 15 are sealed with elastomeric seals 14.

As with the Class 1 garage door 10, the joints between the adjacent garage door panels 15 of the Class 2 garage door 10 are formed with vertically spaced gaps between the respective interior aluminum panels 23 and the corresponding exterior aluminum panels 24. These gaps are covered by a shield 29 that is preferably formed of 6063 aluminum material that can be one-half inch thick and two inches wide. Because the shield 29 is thicker than the adjacent manufactured architectural sheeting 26, the horizontal trim member 28 is formed with a quarter inch deep cavity to receive the depth of the shield 29 protruding from the architectural sheeting 26. The horizontal hinges 12 allow the respective garage door panels 15 to deflect relative to one another to permit a conventional electric motor (not shown) to raise the garage door 10 from the vertical closed position to an elevated horizontal opened position.

The Class 1 garage door 10 is capable of stopping small caliber bullets, such as from 9 mm and .357 caliber hand guns, and even shotguns by using the five-sixteenths thick 6063 interior and exterior aluminum panels 21, 22. The five-eighths thick 6063 interior and exterior aluminum panels 23, 24 form the Class 2 garage door 10 that is capable of stopping bullets fired from most all caliber weapons, except perhaps high powered .50 caliber weapons. The function of the exterior aluminum panels 22, 24 is to allow the bullet to penetrate the exterior aluminum panel 22, 24 while dissipating much of the ballistic energy the bullet carries with it. The exterior aluminum panel 22, 24 is not intended to cause a bullet to ricochet or deflect from the exterior aluminum panel 22, 24 as the penetration of the exterior aluminum panel 22, 24 provides a safer bullet resistant configuration.

The inch thick, soft poly iso insulation member 25 also helps slightly to dissipate some of the energy of the penetrating bullet. The interior aluminum panels 21, 23 will then receive the slowed bullet and allow the bullet to partially penetrate the interior aluminum panel 21, 23. In the event, the bullet is from a small caliber weapon and doesn't have enough energy remaining after penetrating the exterior aluminum panel 22, 24 and the interior core of poly iso insulation material, the slowed small caliber bullet is likely to deflect off the surface of the interior aluminum panel 21, 23, but will not be able to escape the enclosure of the poly iso insulation member 25 between the interior aluminum panels 21, 23 and the exterior aluminum panels 22, 24.

The joints between the adjacent garage door panels 15 are not weak spots in the bullet resistant garage door 10, as is known in prior art structures, due to the vertical spacing of gaps between vertically adjacent interior aluminum panels 21, 23 and the vertically adjacent exterior aluminum panels 22, 24 prevent a horizontally moving bullet from hitting both of the gaps without encountering any resistance. Furthermore, the shield member 29 positioned on the exterior surface of the exterior aluminum panels 22, 24 provide an extra layer of resistance for the passage of a bullet through the structure of the garage door 10. Any horizontally moving bullet aligned with one of the gaps between either adjacent interior aluminum panels 21, 23 or the exterior aluminum panels 22, 24, will be resisted by the shield 29 and either the interior or exterior aluminum panels 21-24.

It will be understood that changes in the details, materials, steps and arrangements of parts which have been described and illustrated to explain the nature of the invention will occur to and may be made by those skilled in the art upon a reading of this disclosure within the principles and scope of the invention. The foregoing description illustrates the preferred embodiment of the invention; however, concepts, as based upon the description, may be employed in other embodiments without departing from the scope of the invention. For example, 6061 aluminum material can be substituted for the preferred 6063 aluminum material used in the interior and exterior aluminum panels 21-24; however, material thicknesses may require adjustment to maintain the desired bullet resistance capability.

Having thus described the invention, what is claimed is:

1. A bullet resistant garage door formed with a plurality of horizontally extending, bullet resistant garage door panels arranged vertically and being hinged together by horizontally disposed hinges to permit a rotational deflection between adjacent garage door panels in order to move the garage door between a vertical closed position and an elevated horizontal closed position, each said garage door panel comprising:

an interior ballistic panel;

an exterior ballistic panel; and a panel of polymeric insulation between said interior and exterior ballistic panels, adjacent garage door panels having a joint therebetween, each said joint having a first gap between the interior ballistic panels of the adjacent garage door panels and a second gap between the exterior ballistic panels of the adjacent garage door panels, said first and second gaps being vertically spaced when said garage door panels are in said vertical closed position.

2. The bullet resistant garage door of claim 1 wherein each said interior ballistic panel, and each said exterior metallic panel is formed of a metallic material.

3. The bullet resistant garage door of claim 2 wherein each said interior metallic panel, and each said exterior metallic panel is formed from 6063 aluminum.

4. The bullet resistant garage door of claim 1 wherein each exterior ballistic panel of an upper garage door panel of vertically adjacent garage door panels includes a shield affixed to an exterior surface thereof, said shield having a height dimension sufficient to overlap both of said first and second gaps.

5. The bullet resistant garage door of claim 4 further comprising:

trim members covering each said exterior ballistic panel to provide an aesthetically pleasing exterior appearance.

6. The bullet resistant garage door of claim 5 wherein said trim members comprise:

a sheeting member covering the exterior surface of said exterior ballistic panel; and a horizontal trim member covering said shield.

7. The bullet resistant garage door of claim 6 wherein said interior ballistic panel and said exterior ballistic panel are affixed to said panel of polymeric insulation by very high bonding adhesive tape.

8. The bullet resistant garage door of claim 6 wherein said shield and said sheeting trim member are affixed to said exterior ballistic panel by very high bonding adhesive tape.

9. A bullet resistant garage door, comprising:

a plurality of vertically disposed garage door panels hinged together to permit a pivotal deflection of each garage door panel relative to an adjacent garage door panel to permit said garage door to move between a vertical closed position and an elevated horizontal opened position, each said garage door panel including:

an interior aluminum panel;

an exterior aluminum panel; and an insulation panel between said interior and exterior aluminum panels;

trim members covering said exterior aluminum panel to provide an aesthetically pleasing exterior appearance; and said vertically adjacent garage door panels having a joint therebetween, each said joint having a first gap between the respective interior aluminum panels of the adjacent garage door panels and a second gap between the respective exterior aluminum panels of the adjacent garage door panels, said first and second gaps being vertically spaced when said garage door is in said vertical closed position.

10. The bullet resistant garage door of claim 9 wherein each exterior aluminum panel of an upper garage door panel of vertically adjacent garage door panels includes a shield affixed to an exterior surface thereof, said shield having a height dimension sufficient to overlap both of said first and second gaps.

11. The bullet resistant garage door of claim 10 wherein each said interior aluminum panel, and each said exterior aluminum panel is formed from 6063 aluminum.

12. The bullet resistant garage door of claim 9 wherein said trim members comprise:

a sheeting member covering the exterior surface of said exterior aluminum panel;

a shield affixed to said exterior ballistic panel to extend below said exterior ballistic panel when said garage door is in said vertical closed position; and a horizontal trim member covering said shield.

13. The bullet resistant garage door of claim 10 wherein said interior aluminum panel and said exterior aluminum panel are affixed to said insulation panel by very high bonding adhesive tape, said shield being affixed to said exterior aluminum panel by very high bonding adhesive tape.

14. A bullet resistant garage door, comprising:

a plurality of vertically disposed garage door panels hinged together to permit a pivotal deflection of each garage door panel relative to an adjacent garage door panel to permit said garage door to move between a vertical closed position and an elevated horizontal opened position, each said garage door panel including:

an interior ballistic panel;

an exterior ballistic panel;

an insulation panel between said interior and exterior ballistic panels; and a shield affixed to said exterior ballistic panel to extend below said exterior ballistic panel when said garage door is in said vertical closed position.

15. The bullet resistant garage door of claim 14 wherein said vertically adjacent garage door panels have a joint therebetween, each said joint having a first gap between the respective interior ballistic panels of the adjacent garage door panels and a second gap between the respective exterior ballistic panels of the adjacent garage door panels, said first and second gaps being vertically spaced when said garage door is in said vertical closed position, said shield having a vertical height greater than the vertical distance between said first and second gaps so that said shield overlaps both said first and second gaps when said garage door is in said vertical closed position.

16. The bullet resistant garage door of claim 15 wherein each said interior ballistic panel, and each said exterior ballistic panel is formed from a metallic material.

17. The bullet resistant garage door of claim 15 wherein each said exterior ballistic panel is covered by trim members to provide an aesthetically pleasing exterior appearance, comprising:

a sheeting member covering the exterior surface of each said exterior ballistic panel; and a horizontal trim member covering the corresponding said shield.

* * * * *